US006178706B1

(12) United States Patent
Nomoto et al.

(10) Patent No.: US 6,178,706 B1
(45) Date of Patent: Jan. 30, 2001

(54) MOVEMENT LIMITING DEVICE FOR BRIDGE BEARING

(75) Inventors: Sadao Nomoto; Chiaki Sudo, both of Kanagawa (JP)

(73) Assignee: Bridgestone Corporation, Tokyo (JP)

( * ) Notice: Under 35 U.S.C. 154(b), the term of this patent shall be extended for 0 days.

(21) Appl. No.: 09/207,679

(22) Filed: Dec. 9, 1998

(30) Foreign Application Priority Data

Dec. 9, 1997 (JP) ..... 9-338714

(51) Int. Cl.[7] ..... E01D 19/04

(52) U.S. Cl. ..... 52/167.1; 14/73.5; 14/77.1; 52/573.1

(58) Field of Search ..... 14/73.5, 77.1, 14/73.1; 254/104; 52/223.8, 223.6, 724.1, 573.1, 167.1, 393

(56) References Cited

U.S. PATENT DOCUMENTS 1,572,574 * 2/1926 Stromborg ..... 52/167.1
3,921,240 * 11/1975 Fyfe ..... 14/73.5
4,187,573 * 2/1980 Fyfe et al. ..... 14/73.5
5,597,240 * 1/1997 Fyfe ..... 384/36
5,802,652 * 9/1998 Smith ..... 14/73
5,978,997 * 11/1999 Grossman ..... 14/73

* cited by examiner

*Primary Examiner*—Christopher T. Kent
*Assistant Examiner*—Jennifer I. Thissell
(74) *Attorney, Agent, or Firm*—Staas & Halsey LLP

(57) ABSTRACT

A movement limiting device of a bridge bearing is provided in which the horizontal strength in the longitudinal direction and the perpendicular direction of a bridge when limitation in movement is cancelled can be suitably separately set. A rubber bearing 64 is interposed between an upper shoe plate 60 and a lower shoe plate 62. The upper shoe plate 60 has a notch 72 formed in a side thereof. A side block 80 has two projections 82, 84, which are formed integrally with the side block 80 to project upwardly. The side block 80 has a plurality of bolt through holes 86, which are formed therein on both end sides of the projections 82 and 84, and another bolt through hole 86, which is also formed in a concave portion 83 between the projections 82 and 84. Bolts 78 fix the side block to the lower shoe plate 62. Upper portions of the projections 82, 84 are positioned in the notch 72 such that there are spaces between the projections 82, 84 and both ends 72*a*, 72*b* of the notch 72, respectively, just for allowing limited movement.

11 Claims, 3 Drawing Sheets

MOVEMENT LIMITING DEVICE FOR BRIDGE BEARING

FIELD OF THE INVENTION

The present invention relates to a movement limiting device which limits the movement of a superstructure (bridge girder) in a bearing portion of a bridge in a horizontal direction.

BACK GROUND OF THE INVENTION

A bridge girder of a bridge may be caused deflection, expansion or contraction in the longitudinal direction of the girder (the direction along the longitudinal axis of the bridge, hereinafter referred to as "bridge longitudinal direction") due to creep of concrete, drying shrinkage, or prestress. A movable bearing has been employed which has a mechanism to support the bridge girder so as to allow horizontal movement of the bridge girder in the bridge longitudinal direction. The movable bearing is provided with a movement limiting device for preventing an upper shoe from deviating from a lower shoe in the event of an earthquake.

FIG. 2 is a schematic perspective view showing a conventional bearing device with a movement limiting device. The movement limiting device comprises an upper shoe plate 10 made of steel, which is provided with a notch 12 formed in a side thereof (extending in the bridge longitudinal direction), and a side block 14 which is secured such that the side block 14 is positioned in the notch 12. There are spaces 13S between the side block 14 and both ends of the notch 12 respectively for allowing limited movement. An anti-floating member 16 is disposed on the side block 14 for preventing the upper shoe 10 from moving upwardly.
This movement limiting device has been employed in various kinds of bearings including a line bearing, a plate bearing, a roller bearing, a locking pier pivot tearing, a rocker bearing, and a rubber bearing).

FIG. 3 is a perspective view of a roller bearing with plural rollers having a movement limiting device. An upper shoe 20 is pivotally mounted to a lower shoe 26 through a pin 22 and caps 24. The lower shoe 26 is supported to a bottom plate 30 through rollers 28 in such a manner that the lower shoe 26 is movable in the bridge longitudinal direction. The lower shoe 26 is provided with notches 32 formed in sides thereof. Upper portions of side blocks 34 secured to the bottom plate 30 are positioned in the notches 32, respectively. A numeral 36 designates an anchor bolt, 38 designates a side block bolt.

FIG. 4 is an exploded perspective view showing a plate bearing with high strength brass bearing plate having a movement limiting device. A bearing plate 44 is interposed between an upper shoe 40 and a lower shoe 42. Disposed around the bearing plate 44 is a seal ring 46.

The upper shoe 40 is provided with notches 48 formed in sides thereof. The lower shoe 42 has integrally formed side blocks 52 of which upper portions are positioned in the notches 48, respectively. Anti-floating members 53 are attached to the side blocks 52 by bolts 50. A numeral 54 designates an anchor bolt.

There is a possibility of a bridge pier fracturing when extremely large force is exerted on a bridge girder in a horizontal direction and a movement limiting device still restrains the bridge girder. Accordingly, there are some movement limiting devices which are designed to cancel the restraint of the bridge girder in such a case. It should be noted that, in this case, an aseismatic connector is further provided besides the movement limiting device.

In the conventional examples as shown in FIGS. 2 through 4, for canceling the restraint of the bridge girder by the movement limiting device, the side blocks 14, 34, 52 are structured to be sheared when the horizontal force exerted on the bridge girder exceeds a predetermined value.

As mentioned above, according to current design of bearings, side blocks are structured to be broken when large horizontal force of such a magnitude as to fracture a bridge pier is exerted on a bridge girder, for ensuring safety in the event of earthquake. This prevents extremely large force from being exerted on bridge piers.

This structure is called the knock-off structure. It is necessary to balance the strength of the side blocks 14, 34, 52 in the bridge longitudinal direction and a direction perpendicular to the bridge longitudinal direction (hereinafter, referred to as "the bridge perpendicular direction") in such a manner that the side blocks can be broken when a horizontal force exceeding the corresponding predetermined value is exerted in the bridge longitudinal direction or the bridge perpendicular direction.

However, nearly all side blocks should have a thinner thickness in the bridge perpendicular direction and a longer length in the bridge longitudinal direction for the structural reason. Accordingly, the strength in the bridge longitudinal direction should be too large relative to the strength in the bridge perpendicular direction.

To balance the strength in the bridge longitudinal direction and the strength in the bridge perpendicular direction of the side blocks 14, 34, 52, for example, portions of the side blocks where positioned in the notches 12, 32, 48 may be set to have reduced length in the bridge longitudinal direction and increased thickness in the bridge perpendicular direction. In this case, however, the whole size of the bearing becomes larger, so it is diseconomy.

OBJECTS AND SUMMARY OF THE INVENTION

It is an object of the present invention to solve the problems as mentioned above and to provide a movement limiting device of a bridge bearing in which horizontal strength in the bridge longitudinal direction and horizontal strength in the bridge perpendicular direction when the movement limitation is cancelled are properly set respectively.

A movement limiting device of a bridge bearing of the present invention comprises an upper member movable in a horizontal direction, a lower member which is fixedly installed to confront the upper member, a notch which is formed in one of the upper and lower members to extend in a bridge longitudinal direction, and a plurality of stoppers which are fixed to the other one of the upper and lower members such that the stoppers are positioned in the notch and spaced apart from each other. When the upper member moves in the bridge longitudinal direction, one of the stoppers comes in contact with a corresponding end of the notch to limit the movement of the upper member. When a horizontal force exceeding a predetermined value is exerted to the upper member, the end of the notch pushes and thus shears the stopper so as to cancel the limitation in the movement of the upper member.

In the movement limiting device of the bridge bearing, when the upper member moves in the bridge longitudinal direction and its travel distance reaches its limit, one of the ends of the notch comes in contact with the corresponding stopper so as to limit the further movement of the upper member. In this case, when the horizontal force is too large, the stopper is sheared, thereby canceling the limitation in the movement of the upper member.

In the present invention, a plurality of (for example, two) stoppers are arranged to be spaced apart from each other in the bridge longitudinal direction, thereby enabling the stoppers to be selectively formed in various configurations to properly set the shearing strength in the bridge longitudinal direction and the shearing strength in the bridge perpendicular direction of the stoppers.

In the present invention, a block confronting the notch and extending in the bridge longitudinal direction may be fixedly disposed, and the stoppers are projections formed on the block. In this case, the notch may be formed in the upper member and the block may be fixed to the lower member by bolts, which are arranged in portions on the end sides of the projections of the block in a longitudinal direction of the block and in a portion between the projections.

In the movement limiting device of the bridge bearing, the block can be fixed by the bolts not only in both sides of the block but also in the center thereof, thereby increasing the strength for fixing the block.

In designing the stoppers including projections formed on the side block as the movement limiting structure of the bearing, it is preferable for absorbing the expansion and contraction of the bridge girder to make the limited distance for allowing movement in the bride longitudinal direction larger. Therefore, the projections may be formed on the side block in configuration just like walls on both sides of the bearing body extending parallel to each other.

The dimensions of the projections of the side block are determined according to the contact pressure between the projections and the upper member such as the upper shoe plate, and the stress of the projections due to a horizontal force in the bridge perpendicular direction.

DETAILED DESCRIPTION OF PREFERRED EMBODIMENTS

Figure 1A:
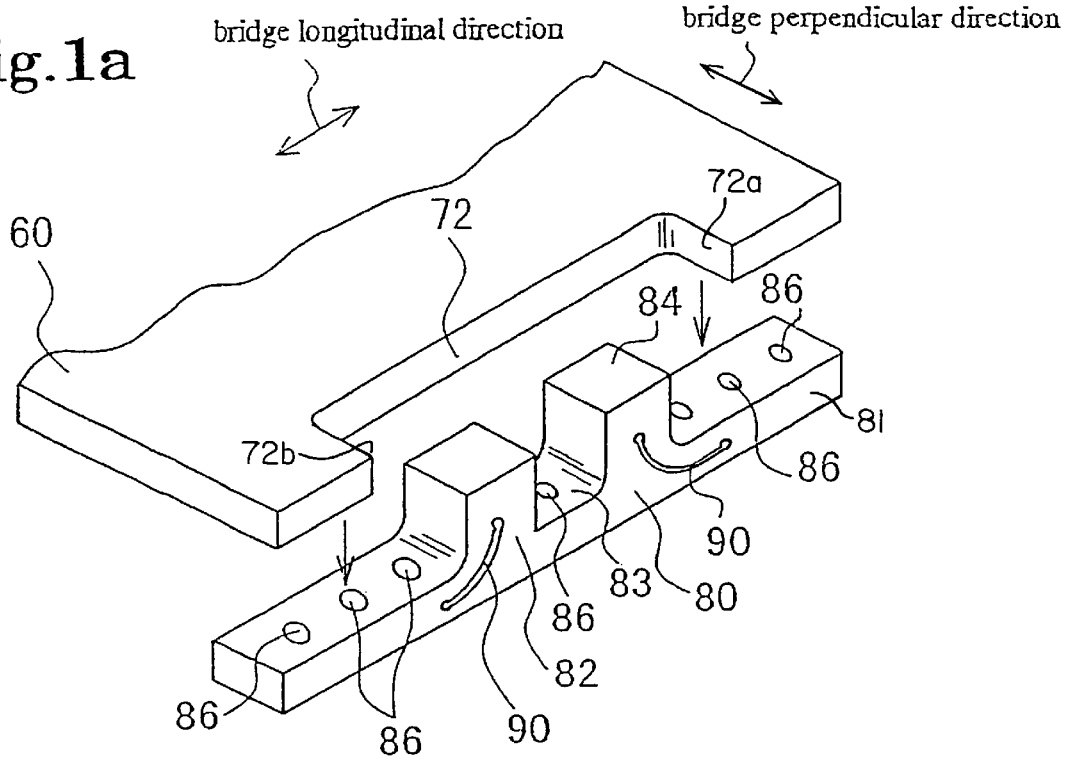
FIG. 1*a* is a perspective view of a side block and an upper shoe plate of a movement limiting device of a bridge bearing according to an embodiment.
Figure 1B:
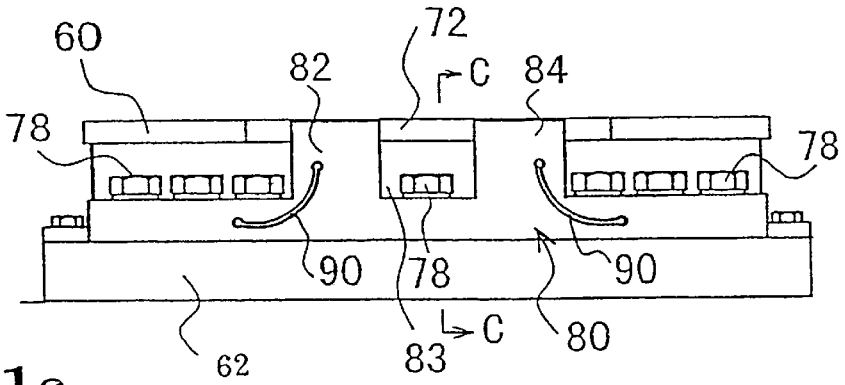
FIG. 1*b* is a side view of a bearing device.
Figure 1C:
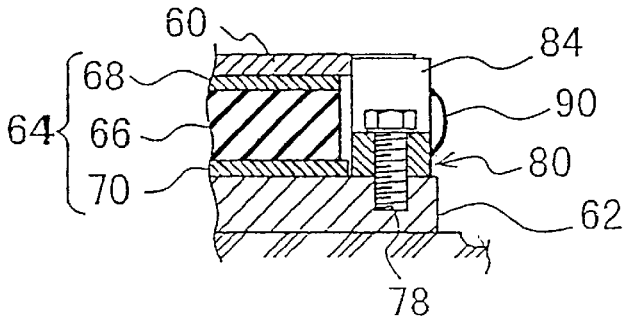
FIG. 1*c* is a sectional view taken along a line C—C of FIG. 1*b;*
Figure 2:
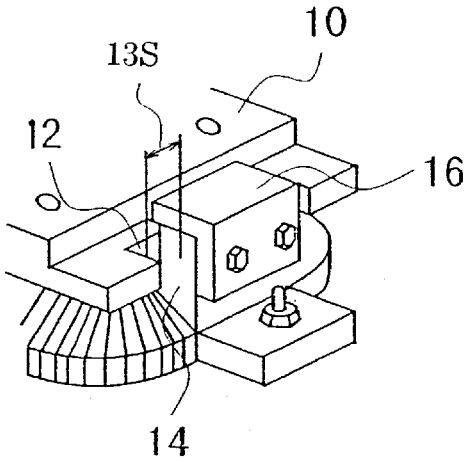
Fig.2 Prior Art
FIG. 2 is a structural view of a movement limiting device of a conventional bridge bearing.

Hereinafter, a movement limiting device of a bridge bearing according to an embodiment will be described with reference to FIGS. 1*a*–1*c*.

A rubber bearing 64 is interposed between an upper shoe plate 60 made of steel as an upper member and an lower shoe plate 62 made of steel as a lower member. The rubber bearing 64 comprises a bearing body 66, an upper flange 68 and a lower flange 70. The bearing body 66 is a layered member of rubber layers and metallic plates. The flanges 68, 70 are bonded respectively to the upper and lower surfaces of the bearing body 66. The upper shoe plate 60 and the lower shoe plate 62 are connected to the upper flange 68 and the lower flange 70 with bolts (not shown).

The upper shoe plate 60 has a notch 72 formed in a side extending in the bridge longitudinal direction thereof. The lower shoe plate 62 has a side block 80, which is fixed to an upper surface of a side portion of the lower shoe plate 62 to extend in the bridge longitudinal direction with bolts 78.

The side block 80 has a main block 81 and two projections 82, 84 as stoppers, which are formed integrally with the main block 81 to project upwardly. The side block 80 has a plurality of bolt through holes 86, which are formed therein on both outer sides of the projections 82 and 84, and another bolt through hole 86, which is also formed in a concave portion 83 between the projections 82 and 84. Each bolt 78 is inserted into the respective bolt through the hole 86.

Upper portions of the projections 82, 84 are positioned in the notch 72 such that there are spaces between the projections 82, 84 and both ends 72*a,* 72*b* of the notch 72, respectively, just for allowing limited movement.

The projections 82, 84 are connected to the main block 81 of the side block 80 through tie wires 90, respectively, in order to prevent the projections from falling when sheared.

In the bearing device as structured above, when the bridge girder is moved in the bridge longitudinal direction due to an earthquake of magnitude in a range from small to medium, the movement of the bridge girder is limited to a distance defined by the spaces between the projections 82, 84 and the notch ends 72*a,* 72*b*. That is, the bridge girder is prevented from further moving in the bridge longitudinal direction because the notch end 72*a* or 72*b* comes in contact with the projection 82, 84.

When a large earthquake occurs, where a horizontal force exerted on the bridge girder exceeds shearing strength of the projections 82, 84 in the bridge longitudinal direction, the notch end 72*a* or 72*b* strongly pushes the projection 32 or 84 so as to shear the projection 82 or 84, thereby canceling the limitation in movement of the bridge girder. This cancellation prevents a bridge pier from being loaded with overstress. When a horizontal force in the bridge perpendicular direction exceeds the sum of shearing strength of both projections 82, 84 in the bridge perpendicular direction in the event of an earthquake, the projections 82 and 84 are sheared in the bridge perpendicular direction, thereby canceling the limitation in movement of the bridge girder.

In this embodiment, in the knock-off structure, which requires a balance of strength of the movement limiting device in the bridge longitudinal direction and the bridge perpendicular direction, the concave portion 83 is formed at the center of the side block 80 as mentioned above. In this structure, even with the side block 80 having increased length in the bridge longitudinal direction and reduced thickness in the bridge perpendicular direction, the two projections 82, 84 of the side block 80 can oppose a horizontal force in the bridge perpendicular direction in which the strength of each projection is lower, and one of the projections 82, 84 divided by the concave portion 83 can oppose a horizontal force in the bridge longitudinal direction. Therefore, the strength in the bridge longitudinal direction and the strength in the bridge perpendicular direction of the projections 82, 84 can be set separately so as to have a balance of strength in the bridge perpendicular direction and the bridge longitudinal direction. The balance of strength in the bridge longitudinal direction and the bridge perpendicular direction of the projections 82, 84 of the side block 80 can be adjusted by the dimensions (length) of the concave portion 83 formed between the projections 82 and 84. Though the bearing body is the rubber bearing in the above embodiment, the present invention may be applied to several bearings such as line bearings, plate bearings (for example in FIG. 4), roller bearings (for example in FIG. 3), rocking pier pivot bearings, and rocker bearings.

Figure 3:
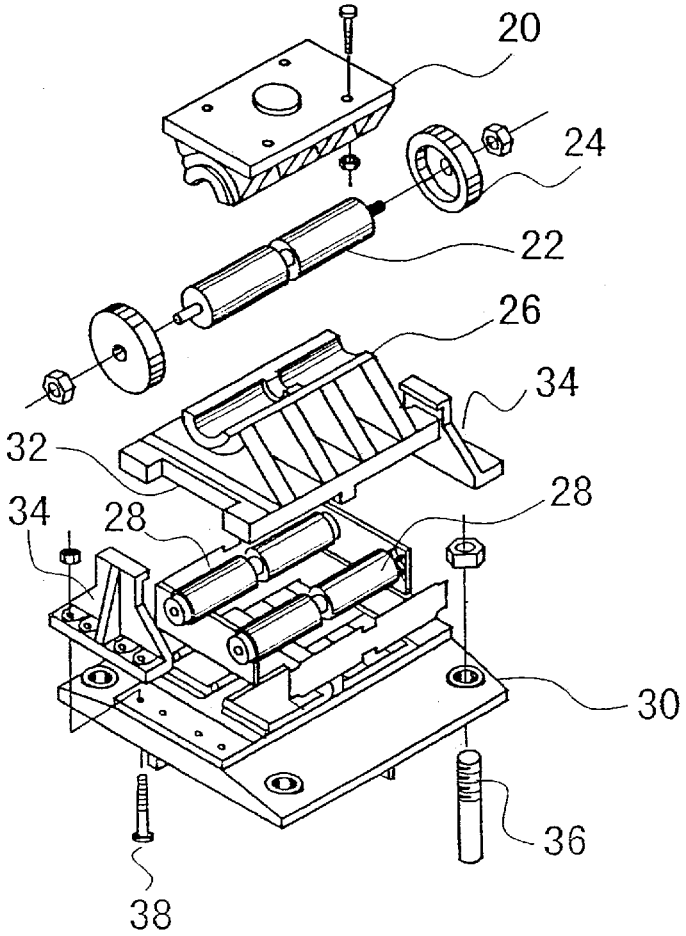
Fig.3 Prior Art
FIG. 3 is an exploded perspective view of a conventional bearing device.
Figure 4:
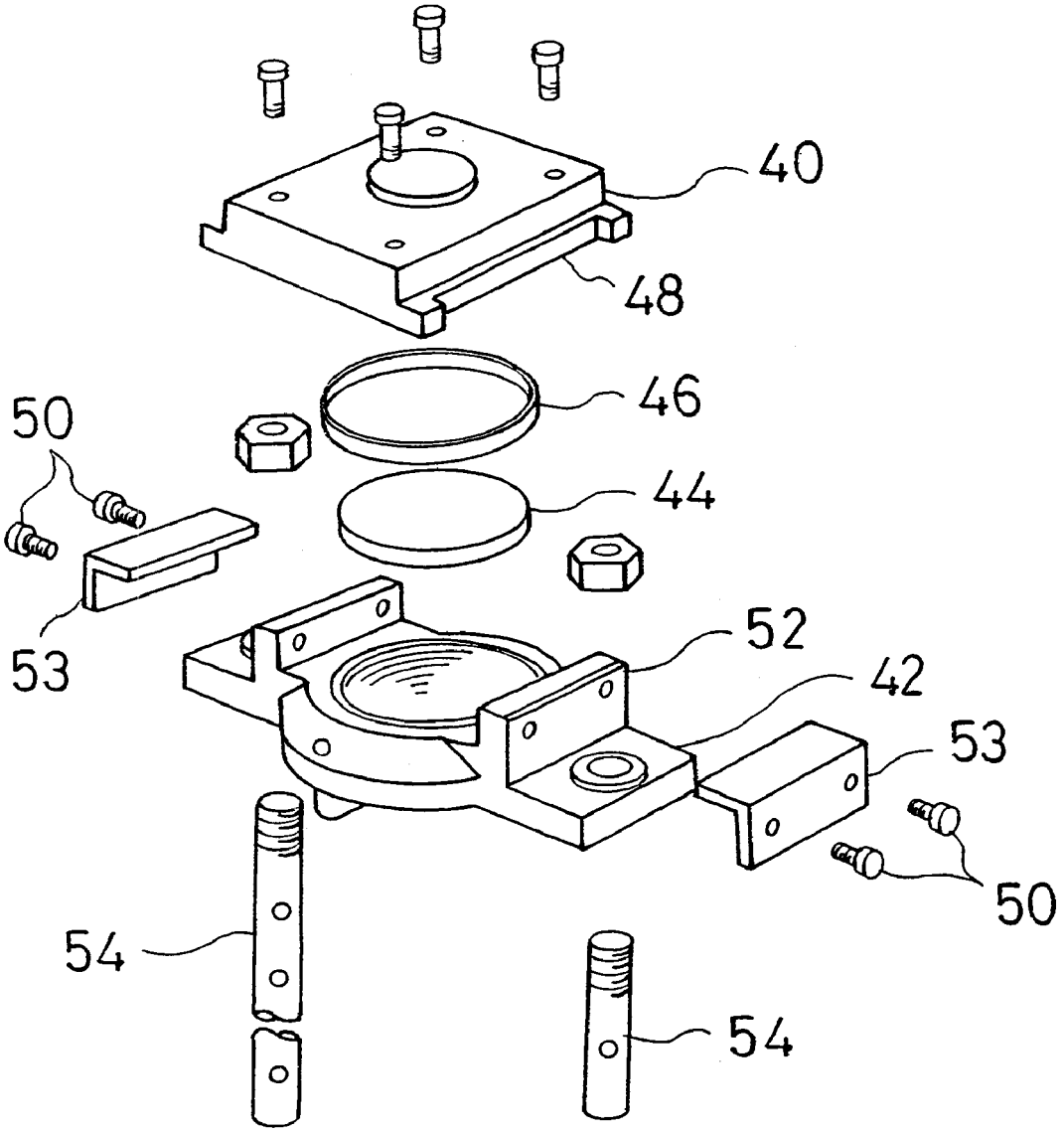
Fig. 4 Prior art
FIG. 4 is an exploded perspective view of another conventional bearing device.

Though the upper member is the upper shoe plate and the lower member is the lower shoe plate in the illustrated embodiment, the upper member may be a lower shoe and the lower member may be a bottom plate just like the case of the roller bearing of FIG. 3 (as more concretely, roller bearing with plural pins). That is, it is required that only the upper member is an upper piece and the lower member is a lower piece of a pair of the pieces which can move relatively to each other.

Though the notch is formed in the upper member (the upper shoe plate) and the side block is fixed to the lower member (the lower shoe plate) in the aforementioned embodiment, the notch may be formed in the lower member and the side block may be fixed to the upper member. Instead of the side block, other members which can engage the notch may be employed as the stoppers.

The yield strength in the bridge longitudinal direction by one of the stoppers may be equal to or different from the yield strength in the bridge perpendicular direction by both stoppers.

As mentioned above, in the movement limiting device of the bridge bearing of the present invention, the strength in the bridge longitudinal direction and the strength in the bridge perpendicular direction of the stoppers can be suitably set respectively. That is, in order to balance the strength in the bridge longitudinal direction and the strength in the bridge perpendicular direction of the projection of the side block as required for the knock-off structure, the projection should be formed as a square in its plan view and not another configuration when the side block has only one projection as conventional examples. However, when the side block has two projections spaced apart from each other in the bridge longitudinal direction, the horizontal force in the bridge perpendicular direction is received by the two projections and the horizontal force in the bridge longitudinal direction is received by one of the projections which comes in contact with the upper shoe plate, thereby increasing the degree of freedom in design of balancing the strength.

When the horizontal force is quite large, the torsional strength of a portion fixing the side block is often lost. In case of the side block having one projection, there are only two portions on both sides of the projection for receiving torsion. On the other hand, in case of the side block having two projections and the concave portion therebetween, a further fixing bolt can be disposed in the concave portion so that the area for receiving torsion becomes twice that of the side block having one projection.

What is claimed is:

1. A movement limiting device of a bridge bearing comprising:

an upper member;

a lower member which is fixedly installed to confront said upper member;

a bearing between said upper and lower members such that said upper member is movable in a horizontal direction;

a notch which is formed in one of said upper and lower members to extend in a bridge longitudinal direction; and a plurality of stoppers which are fixed to the other one of said upper and lower members so that said stoppers are positioned in said notch and spaced apart from each other, said upper member being capable of moving in the bridge longitudinal direction so that one of said stoppers may come in contact with a corresponding end of said notch to limit the movement of said upper member, and whereby the end of said notch pushes and thus shears the stopper so as to cancel the limitation in the movement of said upper member when a horizontal force exceeding a predetermined value is exerted on said upper member.

2. A movement limiting device as claimed in claim 1, further comprising a block confronting said notch and extending in the bridge longitudinal direction, wherein said stoppers are projections formed on said block.

3. A movement limiting device as claimed in claim 2, wherein said notch is formed in said upper member and said block is fixed to said lower member by bolts, which are arranged between an end projection and the end of said block in a longitudinal direction of the block and in a portion between said projections.

4. A movement limiting device as claimed in claim 3, wherein said upper member is an upper shoe plate.

5. A movement limiting device as claimed in claim 4, wherein said upper shoe plate has a side extending in the bridge longitudinal direction, and said notch is provided in the side.

6. A movement limiting device as claimed in claim 5, wherein said notch is rectangular, which extends along said side.

7. A movement limiting device as claimed in claim 6, wherein said block has a main block and two projections protruding upwardly from the main block.

8. A movement limiting device a s claimed in claim 2, further comprising a member which prevents each projection from falling down after the projection is sheared.

9. A movement limiting device as claimed in claim 7, further comprising a wire, one end of which is connected to each projection and the other of which is connected to said main block, so that the projection is prevented from falling down when it is sheared and comes apart from the main block.

10. A movement limiting device for a bridge bearing, comprising:

a movable first member and a fixed second member, one of said first and second members having a notch;

a plurality of stoppers projecting from the other one of said first and second members such that said stoppers are positioned within the notch, one of said stoppers limiting movement of said first member by contacting a corresponding end of the notch, and the notch shearing said stopper when a sufficient force is exerted on said first member.

11. A method for limiting the movement of a bridge bearing with a movable first member and a fixed second member, comprising:

forming a notch in one of the first and second members;

projecting a plurality of stoppers from the other one of the first and second members such that the stoppers are positioned within the notch; and limiting movement of the first member by one of the stoppers contacting a corresponding end of the notch, and the notch shearing the stopper when a sufficient force is exerted on the first member.

* * * * *